US007437822B2

(12) United States Patent
Flagg et al.

(10) Patent No.: US 7,437,822 B2
(45) Date of Patent: Oct. 21, 2008

(54) LOCKING MECHANISM FOR FOLDING KNIFE

(75) Inventors: Douglas B. Flagg, West Linn, OR (US); Pat Haudbine, Tualatin, OR (US); Tong Chiu, Taichung Hsien (TW)

(73) Assignee: GBII Corporation, Tualatin, OR (US)

( * ) Notice: Subject to any disclaimer, the term of this patent is extended or adjusted under 35 U.S.C. 154(b) by 154 days.

(21) Appl. No.: 11/434,365

(22) Filed: May 12, 2006

(65) Prior Publication Data

US 2006/0260137 A1 Nov. 23, 2006

Related U.S. Application Data

(60) Provisional application No. 60/776,568, filed on Feb. 24, 2006, provisional application No. 60/682,526, filed on May 18, 2005.

(51) Int. Cl.
*B26B 1/04* (2006.01)

(52) U.S. Cl. ..... 30/161; 30/160; 7/118

(58) Field of Classification Search ..... 30/160, 30/161, 164, 153, 155, 157, 342, 343; 7/118–120
See application file for complete search history.

(56) References Cited

U.S. PATENT DOCUMENTS 5,495,674 A * 3/1996 Taylor, Jr. ..... 30/160
5,502,895 A 4/1996 Lemaire
5,596,808 A 1/1997 Lake et al.
5,964,036 A 10/1999 Centofante
6,427,335 B1 * 8/2002 Ralph ..... 30/161
6,434,831 B2 * 8/2002 Chen ..... 30/161
7,059,053 B2 * 6/2006 Sakai ..... 30/160
2005/0241154 A1 11/2005 Lake

OTHER PUBLICATIONS

Description of LAWKS® lock saftey device in Columbia River Knife & Tool 2004 catalog, pp. 1 and 3.
Statement of Rodney L. Bremer.

* cited by examiner

*Primary Examiner*—Kenneth E. Peterson
*Assistant Examiner*—Phong Nguyen
(74) *Attorney, Agent, or Firm*—Klarquist Sparkman, LLP

(57) ABSTRACT

A safety mechanism that protects against inadvertent closure of the blade of a folding knife. In one embodiment, the safety mechanism is implemented in a folding knife having a liner lock with a flexible, resilient locking element. The safety mechanism is movable between a safety position in which the safety mechanism interferes with movement of the flexible locking element to its unlocked position and a release position in which the locking element can be moved to its unlocked position for closing the blade. The safety mechanism is resiliently biased toward the safety position and is retained in this position unless sufficient pressure is applied to the safety mechanism to overcome the biasing force. A biasing mechanism, such as a spring, can be used to apply the required biasing force to the safety mechanism.

8 Claims, 13 Drawing Sheets

LOCKING MECHANISM FOR FOLDING KNIFE

CROSS-REFERENCE TO RELATED APPLICATIONS

The present application claims the benefit of U.S. Provisional Application Nos. 60/776,568, filed Feb. 24, 2006, and 60/682,526, filed May 18, 2005, both of which applications are incorporated herein by reference.

FIELD

The present invention concerns a folding knife, and more particularly, a safety mechanism for a folding knife that protects against inadvertent closure of the knife.

BACKGROUND

One form of conventional sport or work knives comprises a handle and one or more folding blades. The blades in such knives are closed simply by pressing on the back of the blade and rotating the blade to a closed position in the knife handle. Such knives are known for their ability to close when being used if a pressure is inadvertently applied to the back of the blade.

To protect against inadvertent closure, locks were developed for locking a blade in an open position. A common type of locking element known as a liner lock extends longitudinally through the handle and is spring biased to snap into position adjacent to the hinged end (tang) of the blade when the blade is opened. As long as the locking element is retained in the locked position behind the blade, the locking element prevents the blade from pivoting to the closed position. A projecting portion of the locking element or other release mechanism is manipulated to manually move the locking element laterally away from the blade swing path so that the blade can be closed.

Folding knives having such liner locks have become common. However, because the lock feature is defeated by manipulation of an element on the knife handle, the lock can be defeated inadvertently during use of the knife if sufficient pressure is applied to the flexible locking element. To protect against inadvertent movement of the locking element, U.S. Pat. No. 5,596,808 discloses a safety mechanism that is manually movable to a safety position in which the mechanism interferes with the movement of the locking element to its unlocked position. To close the blade, the safety mechanism is first moved to a release position, which then allows the locking element to be moved to its unlocked position so that the blade can be closed.

While the device of the '808 patent is an improvement to the conventional liner lock, there is a continuing need for new and improved devices for folding knives that protect against the inadvertent closure of the knife blade.

SUMMARY

The present disclosure concerns embodiments of a safety mechanism that protects against inadvertent closure of the blade of a folding knife. In one aspect, the safety mechanism is implemented in a folding knife having a liner lock with a flexible, resilient locking element. When the locking element is retained in the locked position engaging the opened blade, the blade is prevented from closing. The safety mechanism is movable between a safety position in which the safety mechanism interferes with movement of the flexible locking element to its unlocked position and a release position in which the locking element can be moved to its unlocked position for closing the blade. The safety mechanism is resiliently biased toward the safety position and is retained in this position unless sufficient pressure is applied to the safety mechanism to overcome the biasing force. A biasing mechanism, such as a spring, can be used to apply the required biasing force to the safety mechanism.

In order to close the blade, sufficient pressure is applied to the safety mechanism to overcome the biasing force on the safety mechanism and move it to the release position. While pressure is being applied to the safety mechanism to hold it in the release position, sufficient pressure is applied to the locking element to move it laterally away from the blade to its unlocked position to allow the blade to be pivoted closed.

The safety mechanism in one disclosed embodiment comprises a locking lever that is mounted to the pivot pin of the blade. The locking lever can be manually pivoted by a user between the safety position and the release position. In another disclosed embodiment, the safety mechanism comprises a slidable latch coupled to the handle of the knife.

In another aspect, the safety mechanism is implemented in a folding knife having a locking pin that engages the blade of the knife when the blade is in the open position. The blade is adapted to be displaced with respect to the handle portion within the plane of the blade between a locked position engaging the locking pin and an unlocked position removed from engagement with the locking pin. A biasing mechanism applies a biasing force to the blade to resiliently retain the blade in the locked position engaging the locking pin. The safety mechanism is movable between a safety position in which it interferes with displacement of the blade to the unlocked position and a release position in which the blade can be moved to the unlocked position. The safety mechanism is resiliently biased toward the safety position and is retained in this position unless sufficient pressure is applied to the safety mechanism to overcome the biasing force.

In one representative embodiment, a folding knife comprises a handle portion and a blade pivotally coupled to the handle portion and operable to pivot relative to the handle portion between an open position for use and a folded, closed position. A locking mechanism of the knife has a locking element that is movable between a locked position and an unlocked position. When the locking element is in the locked position, the locking element prevents pivoting of the blade from the open position to the closed position, and when the locking element is in the unlocked position, the blade can be pivoted from the open position to the closed position. The knife also includes a safety mechanism that is movable between a safety position and a release position. When the safety mechanism is in the safety position, the safety mechanism prevents movement of the locking element to the unlocked position, and when the safety mechanism is in the release position, the locking element can be moved to the unlocked position. The safety mechanism is resiliently biased toward the safety position. In order to move the safety mechanism to the release position, sufficient pressure must be applied to the safety mechanism to overcome the biasing force retaining the safety mechanism in the safety position.

In particular embodiments, a biasing mechanism is coupled to the safety mechanism and provides the biasing force for urging the safety mechanism to the safety position. The biasing mechanism can comprise, for example, a spring such as a coiled compression or tension spring, a torsion spring, a cantilevered spring, or a bent metal spring. Other types of biasing mechanism, such as a spring-loaded piston assembly, also can be used.

In another representative embodiment, a folding knife comprises a handle portion and a blade pivotally coupled to the handle portion and operable to pivot relative to the handle portion about a pivot axis between an open position for use and a folded, closed position. A locking mechanism comprises a leaf spring disposed in the handle portion and is biased to a locked position contacting and in line with the blade for preventing pivoting of the blade from the open position to the closed position. The leaf spring is movable laterally of the handle portion from the locked position to an unlocked position in which the blade can pivot from the open position to the closed position. The knife further includes a safety mechanism that is coupled to the handle portion and operable to pivot about the pivot axis between a safety position and a release position. When the safety mechanism is pivoted to the safety position, the safety mechanism prevents the leaf spring from being moved to the unlocked position, and when the safety mechanism is pivoted to the release position, the safety mechanism allows the leaf spring to be moved to the unlocked position. In addition, the safety mechanism is resiliently biased to the safety position.

In another representative embodiment, a folding knife comprises a handle portion and a blade pivotally coupled to the handle portion for pivoting movement of the blade between an open position and a closed position, the blade defining a plane within which the blade pivots. The blade can be displaced relative to the handle portion in the plane between a locked position and an unlocked position. A locking member is configured to engage and lock the blade against movement when the blade is in the open and locked positions. The blade can be displaced within the plane to the unlocked position in which the blade is removed from engagement with the locking member and can be pivoted to the closed position. A safety mechanism is moveable between a safety position and a release position, with the safety mechanism being resiliently biased to the safety position. When the safety mechanism is in the safety position, the safety mechanism prevents displacement of the blade from the locked position to the unlocked position, and when the safety mechanism is in the release position, the blade can be displaced to the unlocked position and then pivoted to the closed position.

In another representative embodiment, a method of using a folding knife is provided. The knife comprises a handle portion, a blade pivotally coupled to the handle portion and operable to pivot relative to the handle portion between an open position and a folded, closed position, and a locking element movable between a locked position to prevent pivoting of the blade and unlocked position to allow pivoting of the blade. The method comprises closing the blade from the open position, the act of the closing the blade comprising moving a safety mechanism from a safety position to a release position against a biasing force acting on the safety mechanism, moving the locking element to the unlocked position while the safety mechanism is in the release position, and pivoting the blade to the closed position once the locking element is in the unlocked position.

The foregoing and other objects, features, and advantages of the invention will become more apparent from the following detailed description, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contains A or B or A and B, and optionally one or more other components such as C.

Figure 1:
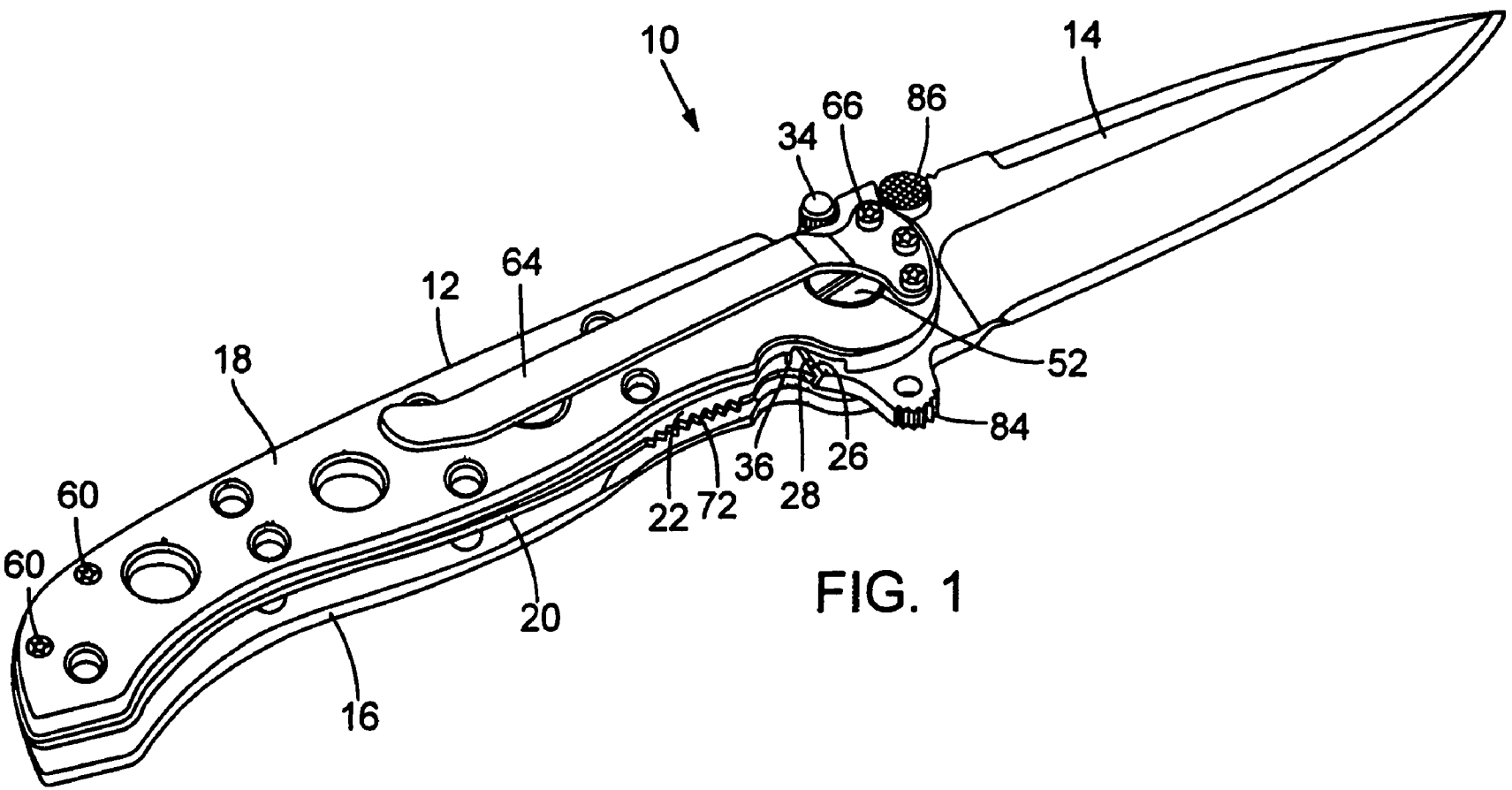
FIG. 1 is a perspective view of a folding knife shown with the blade in an open position, according to one embodiment.
Figure 2:
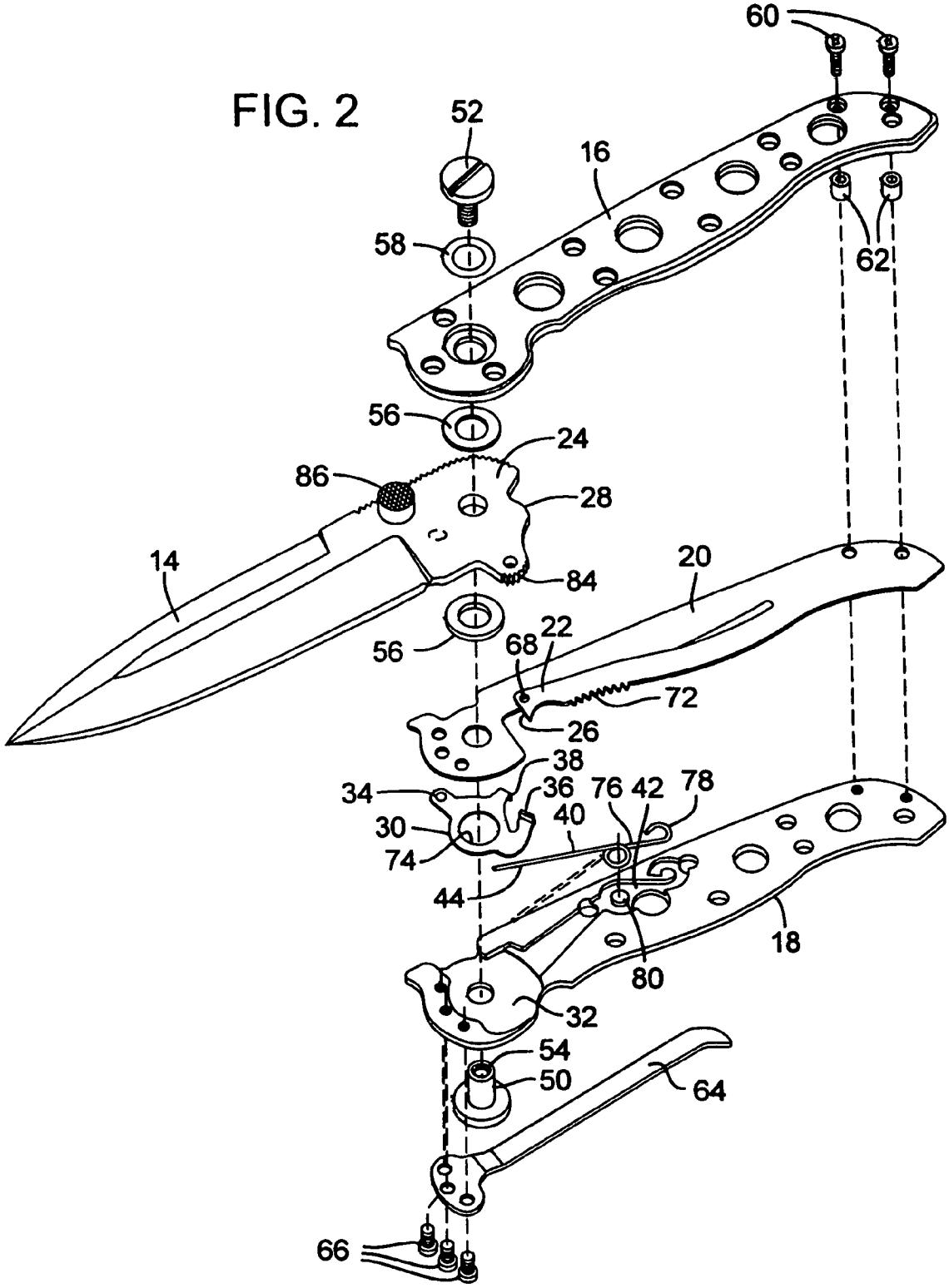
FIG. 2 is an exploded, perspective view of the folding knife of FIG. 1

FIGS. 1-8 illustrate a folding knife 10, according to one embodiment. As best shown in FIGS. 1 and 2, the knife 10 comprises a handle portion 12 and a blade 14 pivotally connected to the handle portion in a conventional manner for pivoting between a folded, closed position in which the blade is at least partially received in the handle portion and an open or use position (FIG. 1). The handle portion 12 comprises first and second side panels 16 and 18, respectively, connected to a tang portion 24 of the blade 14 by a pivot assembly comprising a pivot pin 50 and a screw 52. Disposed between the side panels 16, 18, is a locking mechanism comprising a conventional liner lock 20. The pivot pin 50 extends through corresponding openings in the side panels 16, 18, the liner lock 20, the tang portion 24, and washers 56 on opposite sides of the tang portion 24. The screw 52 extends through a washer 58 and is tightened into a threaded opening 54 in the pivot pin 50 to secure the assembly together.

The handle portion 12 can be held together in a conventional manner, such as by screws 60 extending through the side panel 16, spacers 62, and the liner lock 20, and tightened into corresponding openings in the side panel 18. An optional clip 64 can be secured to the side panel 18 by screws 66 as shown in the drawings. The tang portion 24 can be formed with a user-engageable projection 84 that can be used to open the blade 14 using one hand, as known in the art. Provided on opposite sides of the tang portion 24 are studs 86 that engage corresponding surfaces of the handle portion 12 when the blade is in the open and closed positions.

Figure 8:
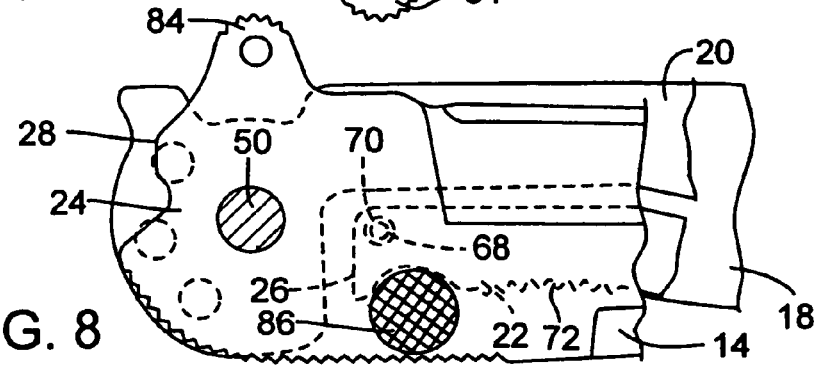
FIG. 8 is an enlarged, fragmentary view of the tang portion of the blade and the liner lock similar to FIG. 7, but showing the blade in a closed position.

The liner lock 20 has a moveable locking element comprising a flexible locking arm 22 (also referred to as a leaf spring) that is resiliently biased toward the tang portion 24 of the blade 14. The locking arm 22 has an end edge 26 that can contact a corresponding edge 28 of the tang portion 24. When the blade is closed or in the folded position (as shown in FIG. 8), the locking arm 22 bears against the side of the tang portion 24, in what is referred to as an unlocked position, and the blade 14 is free to rotate. The locking arm 22 can include a small projection 68 that is received in a corresponding detent 70 (FIGS. 7 and 8) formed in the tang portion to assist in maintaining the blade 14 in the closed position within the handle portion 12.

When the blade is pivoted to the fully open position (FIG. 7), the free end of the locking arm 22 snaps into a locked position behind and in line with the tang portion 24. In this locked position, the locking arm 22 prevents pivoting of the blade 14 from the open position to the closed position. To return the blade to the closed position, the locking arm 22 is moved laterally toward the side panel 18 until the free end of the locking arm 22 clears the edge 28 of the tang portion 24. This can be accomplished by pressing on the exposed bottom edge 72 of the locking arm 22 in a direction toward the side panel 18 with a thumb while holding the knife upside down in the hand. As best shown in FIG. 1, the exposed bottom edge 72 of the locking 22 can be formed with a series of grooves or serrations 72 providing a gripping surface to assist the user in moving the locking arm 22 to the unlocked position.

To secure the liner lock 20 in the locked position, a safety mechanism, or safety lock, 30 is provided. As best shown in FIG. 2, the safety mechanism 30 in the illustrated configuration is disposed in a recess 32 formed in the inside surface of the side panel 18. The pivot pin 50 extends through a central opening 74 in the safety mechanism 30 to permit pivoting of the safety mechanism about the pivot axis of the blade 14.

The safety mechanism 30 comprises a user-engageable finger tab or projection 34 for manually engagement of the safety mechanism, a first laterally bent tab portion 36 projecting toward the first side panel 16, and a second laterally bent tab portion 38 projecting toward the second side penal 18. The safety mechanism 30 can be rotated within the recess 32 by moving the tab portion 34 in the clockwise or counterclockwise directions (as indicated by double-headed arrow 48 in FIG. 3). When the tab portion 34 is in a forward-most position closest to the forward end of the handle portion 12 (referred to as a safety or locked position) (shown in solid lines in FIG. 3), the tab portion 36 is located at a position adjacent to a side surface of the locking arm 22. In this position, the tab portion 36 prevents lateral movement of the locking arm 22 toward the side panel 18 to the unlocked position (as best shown FIGS. 3, 4, and 6) to protect against inadvertent closure of the blade 14. When the tab portion 34 is pivoted to a rear-most position toward the rear of the handle portion 12 (referred to as a release position) (shown in phantom in FIG. 3), the tab portion 36 is moved to a location forwardly of the free end of the locking arm 22, thereby allowing the locking arm 22 to be moved to its unlocked position so that the blade 14 can be closed.

A biasing mechanism, such as the illustrated cantilevered spring 40, biases the safety mechanism 30 to the safety position to protect against inadvertent movement of the safety mechanism 30 to the release position. The spring 40 in the illustration configuration is formed from a piece of resilient metal wire, although the spring can comprise other shapes or forms. For example, the spring can be formed from a flat strip of metal.

Figure 3:
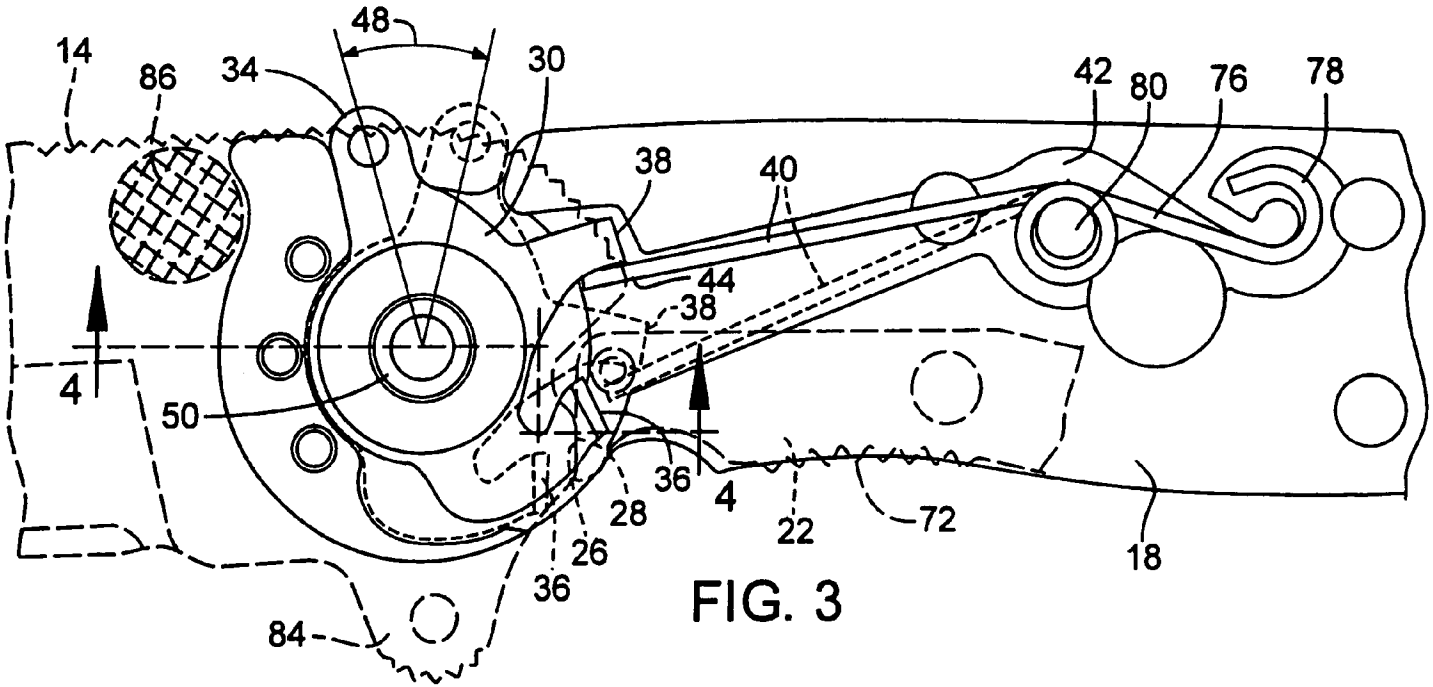
FIG. 3 is an enlarged, fragmentary inside view of the knife of FIG. 1 showing the operation of a safety mechanism that protects against inadvertent closure of the knife.
Figure 4:
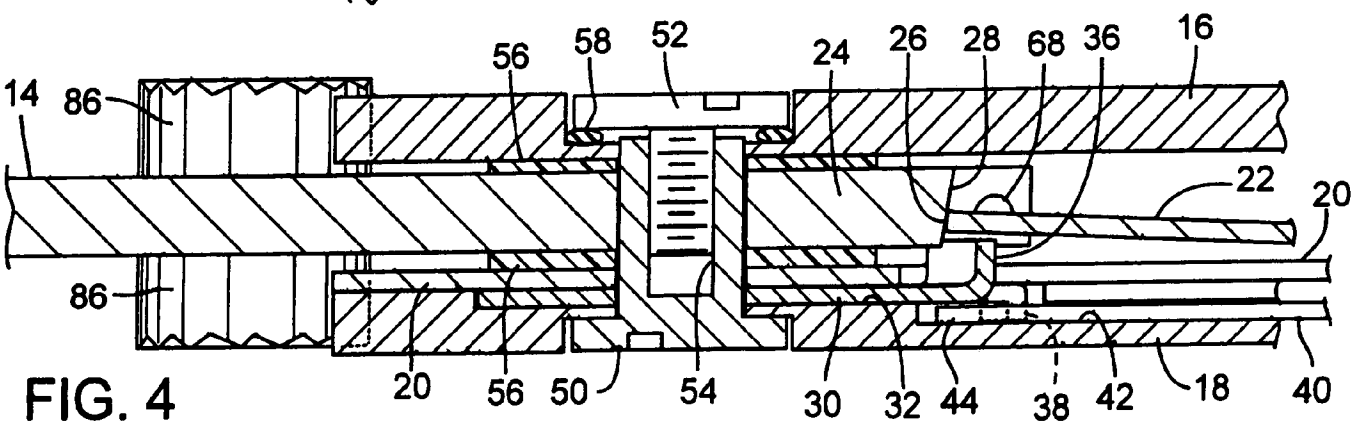
FIG. 4 is a cross-sectional view taken generally along line 4-4 of FIG. 3.
Figure 5:
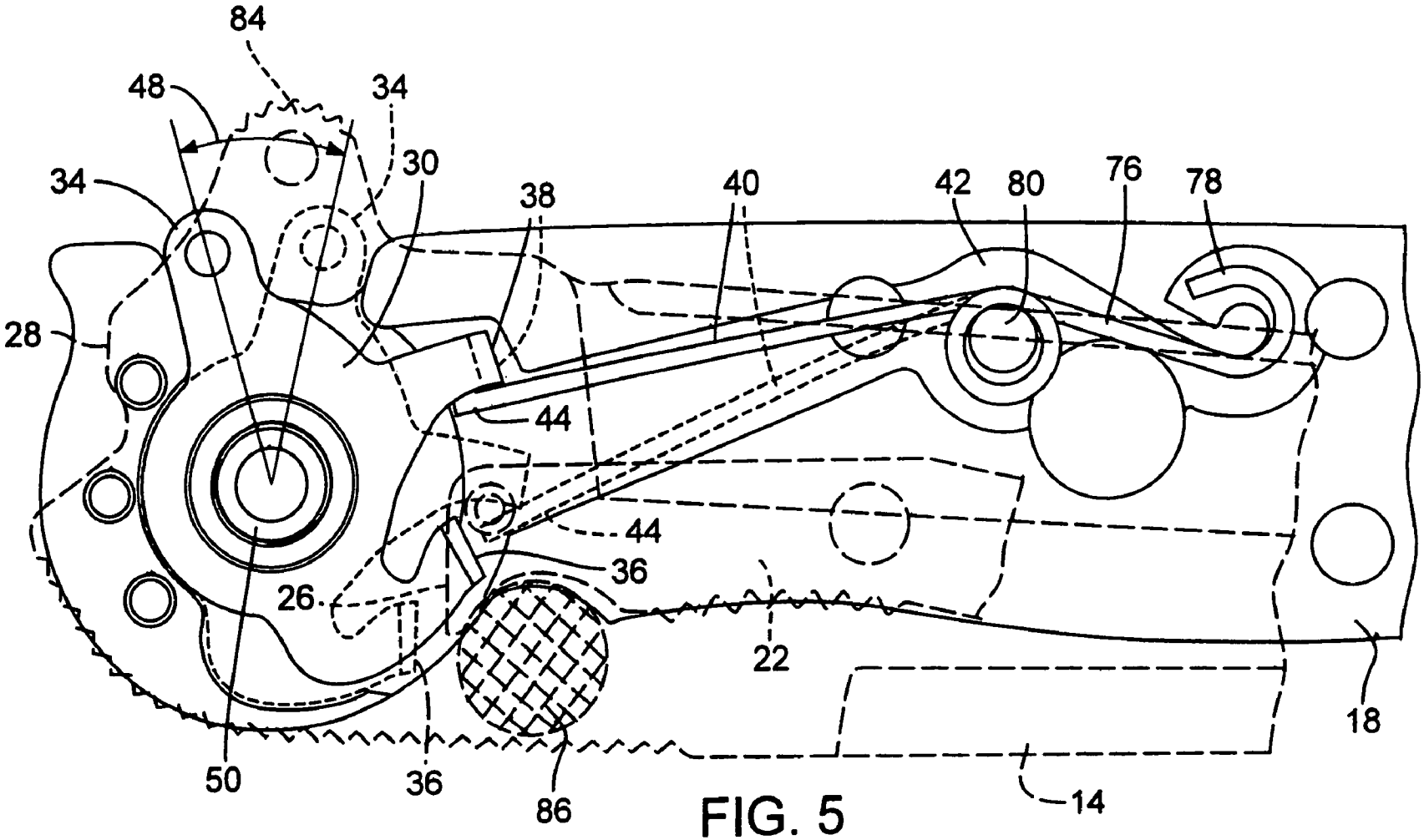
FIG. 5 is an enlarged, inside view of the knife similar to FIG. 3, but showing the blade in the closed, folded position.
Figure 6:
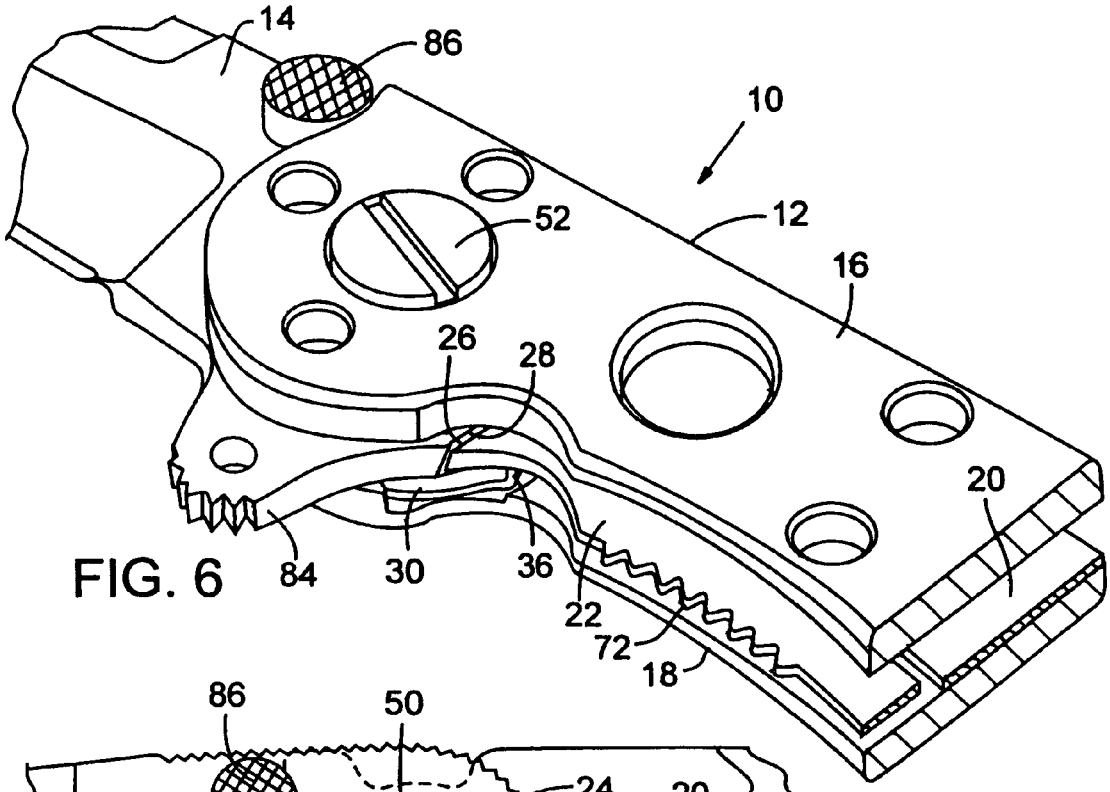
FIG. 6 is an enlarged, fragmentary perspective view of the knife, as viewed from the bottom of the handle and showing the safety mechanism in a safety position engaging the liner lock of the knife.
Figure 7:
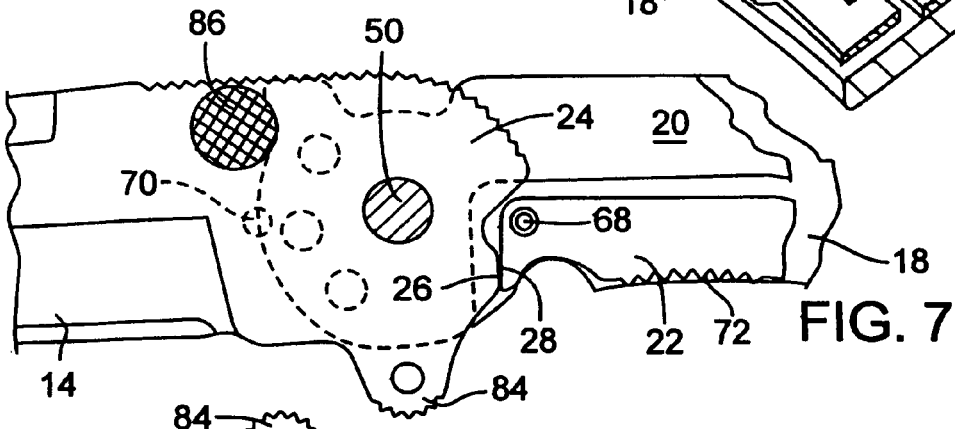
FIG. 7 is an enlarged, fragmentary view of the tang portion of the blade and the liner lock showing the blade in an open position and the liner lock in a locked position engaging the tang portion.

The spring 40 is disposed in a recess 42 (FIG. 2) formed in the inner surface of the side panel 18. As best shown in FIG. 4, recess 42 is slightly deeper than recess 32 and receives the second tab portion 38 of the safety mechanism 30. The spring 40 has a free end portion 44 that bears against the lower edge of the tab portion 38 (as best shown in FIG. 3). The spring 40 has a fixed end portion 76 that is retained at a fixed position in the side panel 18 by virtue of a curved portion 78 of the spring that is received in a similarly shaped portion of the recess 42 and a post 80 formed in the recess and extending through a coil of the fixed end portion 76 of the spring 40. In alternative embodiments, the fixed end portion of the spring 40 can be retained at a fixed position using other techniques or mechanisms, for example, by welding or fastening the spring directly to the side panel 18.

When there is no pressure applied to the tab portion 34, the generally upwardly directed biasing force of the spring 40 against the tab portion 38 maintains the safety mechanism 30 in the safety position (shown in solid lines in FIG. 3). To move the safety mechanism 30 to the release position, the tab portion 34 is moved in the clockwise direction in FIG. 3 toward the rear of the handle portion to rotate the safety mechanism against the biasing force of the spring 40. As long as sufficient pressure is maintained on the tab portion 34 to retain the safety mechanism 30 in the release position, the locking arm 22 of the liner lock 20 can be moved laterally to its unlocked position to permit closing of the blade. As can be appreciated, the safety mechanism 30 advantageously is normally retained in the safety position by the biasing force of the spring and therefore protects against inadvertent movement of the liner lock to its unlocked position and closing of the blade unless sufficient positive pressure is applied to the tab portion 34 to overcome the biasing force of the spring 40.

Figure 9:
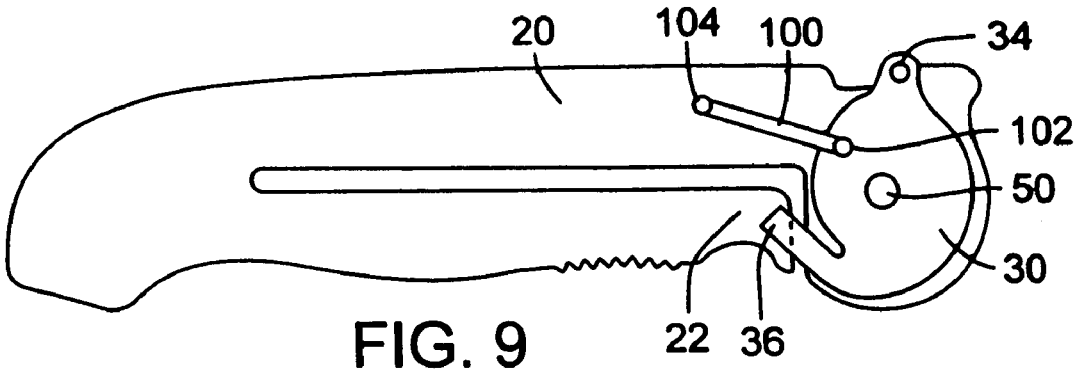
FIG. 9 is a schematic side elevation view of a safety mechanism and liner lock for a folding knife, according to another embodiment.

Other types of biasing mechanisms can be implemented in the knife 10 to bias the safety mechanism 30 toward the safety position. FIG. 9, for example, shows a flexible, resilient bar or leaf spring 100 disposed in a recess formed in the inner surface of a side panel 18 (not shown in FIG. 9) of a knife. The bar 100 has a first end portion 102 secured to the safety mechanism 30 and a second end portion 104 secured to the inner surface of the side panel 18. The bar 100 exerts a biasing force on the safety mechanism 30 to urge the safety mechanism to the safety position shown in FIG. 9.

Figure 10:
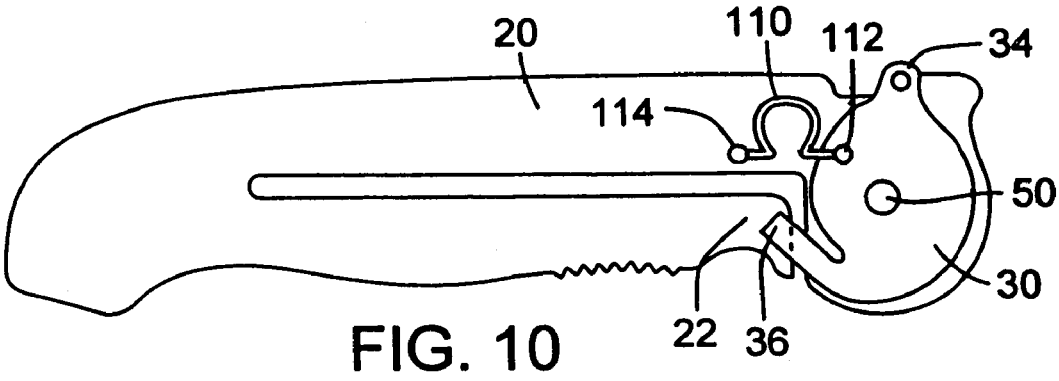
FIG. 10 is a schematic side elevation view of a safety mechanism and liner lock for a folding knife, according to another embodiment.

FIG. 10 shows a biasing mechanism comprising an "Omega" shaped spring 100 disposed in a recess formed in the inner surface of a side panel 18 (not shown in FIG. 10) of a knife. The spring 100 has a first end portion 112 secured to the safety mechanism 30 and a second end portion 114 secured to the inner surface of the side panel 18.

Figure 11:
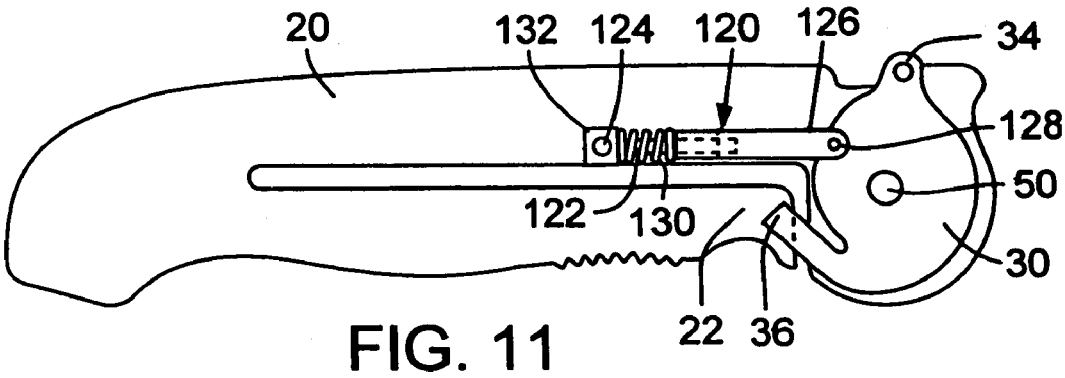
FIG. 11 is a schematic side elevation view of a safety mechanism and liner lock for a folding knife, according to another embodiment.

FIG. 11 shows a biasing mechanism comprising a retractable and extendable piston assembly 120. The illustrated piston assembly 120 comprises a piston arm 122 pivotally connected to a side panel 18 (not shown in FIG. 11) at a pivot pin 124 and a sleeve 126 pivotally connected to the safety mechanism 30 at a pivot pin 128. The piston arm 122 is slidably received in an axial bore formed in the sleeve 126. A compression spring 130 disposed on the piston arm 122 extends between the rear end of the sleeve 126 and an enlarged end portion 132 of the piston arm 122. The biasing force of the spring 130 causes translational movement of the sleeve 126 relative to the piston arm 122 toward the safety mechanism, which is translated into clockwise rotational movement of the safety mechanism 30 to the safety position shown in FIG. 11 due to the pivotal connections at 124 and 128.

Figure 12:
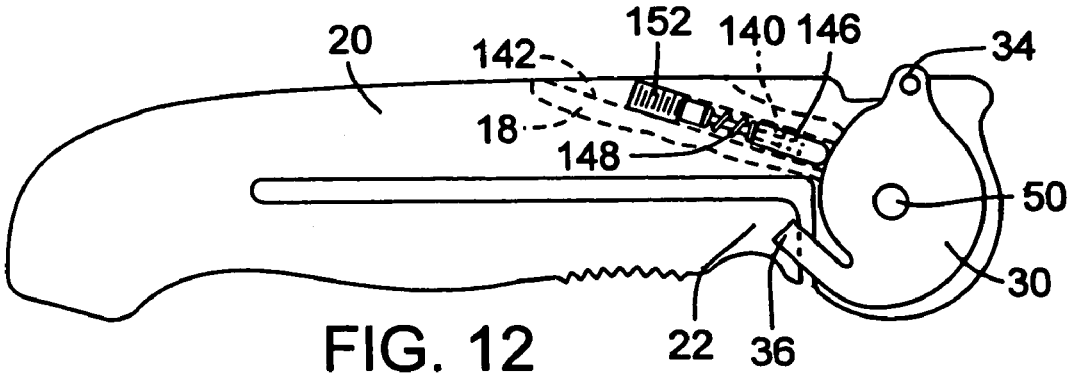
FIG. 12 is a schematic side elevation view of a safety mechanism and liner lock for a folding knife, according to another embodiment.

FIG. 12 shows an embodiment comprising a piston assembly 140 that is disposed in a slot or bore 142 formed in a side panel 18 (not shown in FIG. 12) of a knife. The piston assembly 140 includes a piston arm 144 slidably received in a sleeve, or cylinder, 146. The slot 142 can be fitted with a removable end cap 152 that retains the piston assembly in the slot 142, but yet can be removed to permit removal of the piston assembly 140 without disassembling the entire knife. A compression spring 148 disposed on the piston arm 144 extends between the rear end of the sleeve 146 and an enlarged end portion 150 of the piston arm 144. The spring 148 urges the sleeve 146 against the side edge of the safety mechanism 30 to resiliently retain the safety mechanism in the safety position shown in FIG. 12. As the safety mechanism is moved to the release position (in the counterclockwise direction in FIG. 12), the safety mechanism pushes the sleeve 146 upwardly in the slot 142 against the spring 148. Releasing pressure from the safety mechanism 30 allows the sleeve 146 to extend under the force of the spring 148, which in turn produces a camming action against the safety mechanism, causing the safety mechanism to pivot back to the safety position (in the clockwise direction in FIG. 12).

Figure 13:
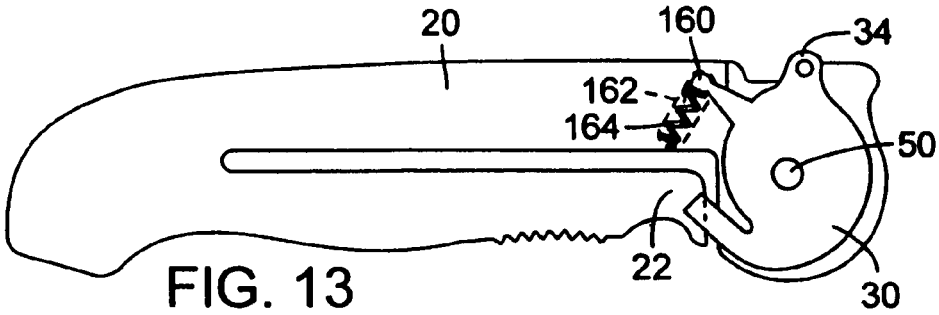
FIG. 13 is a schematic side elevation view of a safety mechanism and liner lock for a folding knife, according to another embodiment.

FIG. 13 shows an embodiment in which a tab portion 160 of the safety mechanism 30 is disposed in a slot 162 formed in a side panel 18 (not shown in FIG. 13) of a knife. A compression spring 164 or other biasing mechanism disposed in the slot 162 provides a biasing force against the tab portion 160 to yieldably urge the safety mechanism 30 in the counterclockwise direction in FIG. 13 toward the safety position.

Figure 14:
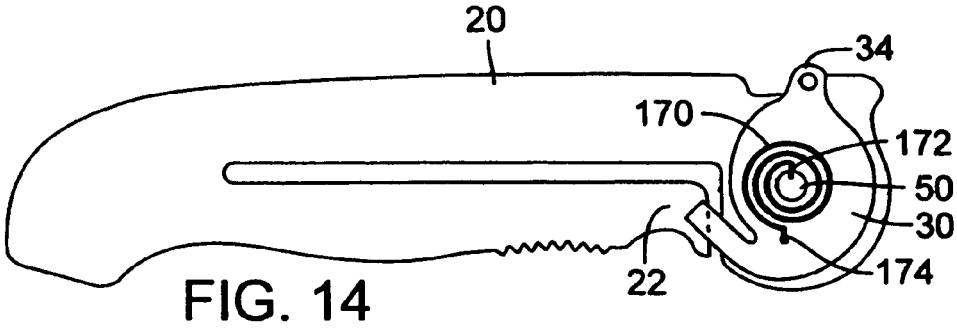
FIG. 14 is a schematic side elevation view of a safety mechanism and liner lock for a folding knife, according to another embodiment.

FIG. 14 shows a biasing mechanism for the safety mechanism 30 comprising a torsion spring 170. The spring 170 has one end 172 secured to pivot pin 50 extending through the safety mechanism 30 and another end 174 secured to the safety mechanism 30. The spring 170 resiliently urges the safety mechanism in the counterclockwise direction in FIG. 14 toward the safety position.

Figure 15:
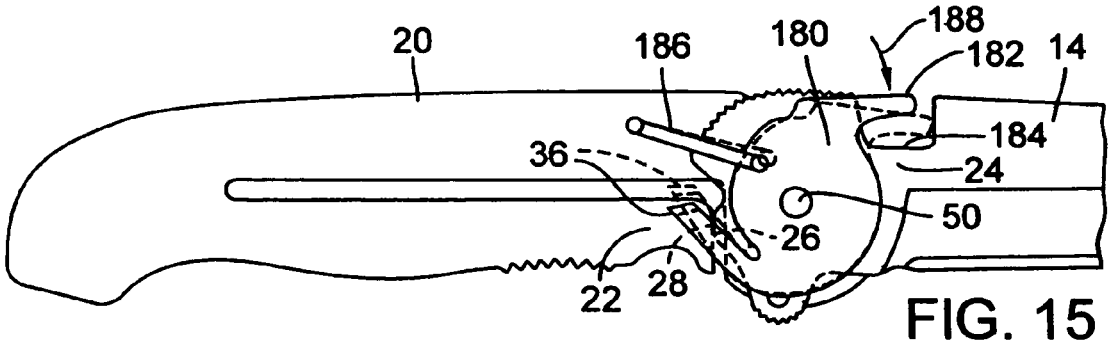
FIG. 15 is a schematic side elevation view of a safety mechanism and liner lock for a folding knife, according to another embodiment.

FIG. 15 shows a safety mechanism 180, according to another embodiment, that has a construction similar to that of safety mechanism 30 previously described, except that safety mechanism 180 includes a forwardly projecting extension portion, or lever, 182 that extends over the upper edge of the blade 14 for manual engagement by a user. Safety mechanism 180 can be pivoted about the pivot pin 50 between a safety position (shown in solid lines in FIG. 15) in which the tab portion 36 prevents lateral movement of the locking arm 22 to its unlocked position and a release position (shown in phantom in FIG. 15) in which the locking arm 22 is allowed to move to its unlocked position. A recess 184 formed along the upper edge of the tang portion 24 is sized to receive the lever 182 when the safety mechanism is moved to the release position.

The safety mechanism can be provided with a biasing mechanism, such as the illustrated spring 186 having one end secured to the safety mechanism and another end secured to a portion of the liner 20 or one of the side panels (not shown in FIG. 15). In other embodiments, any of the various other biasing mechanism disclosed herein can be used to bias the safety mechanism toward the safety position (shown in solid lines in FIG. 15). Pressing down on the lever 182 into the recess 184 (as indicated by arrow 188) against the biasing force of the spring causes the safety mechanism to rotate in the clockwise direction in FIG. 15. This rotation moves the tab portion 36 beyond the locking arm 22 so that it can be moved to its unlocked position for closing the knife (shown in phantom in FIG. 15). When pressure on the lever 182 is released, the spring 186 moves the safety mechanism back to the safety position. In another implementation, the spring 186 can be configured to provide a biasing force that urges the safety mechanism in the clockwise direction to the safety position. To move the safety mechanism to the release position, the lever 182 is pulled upwardly to rotate the safety mechanism in the counterclockwise direction until the tab portion 36 clears the locking arm 22.

Figure 16A:
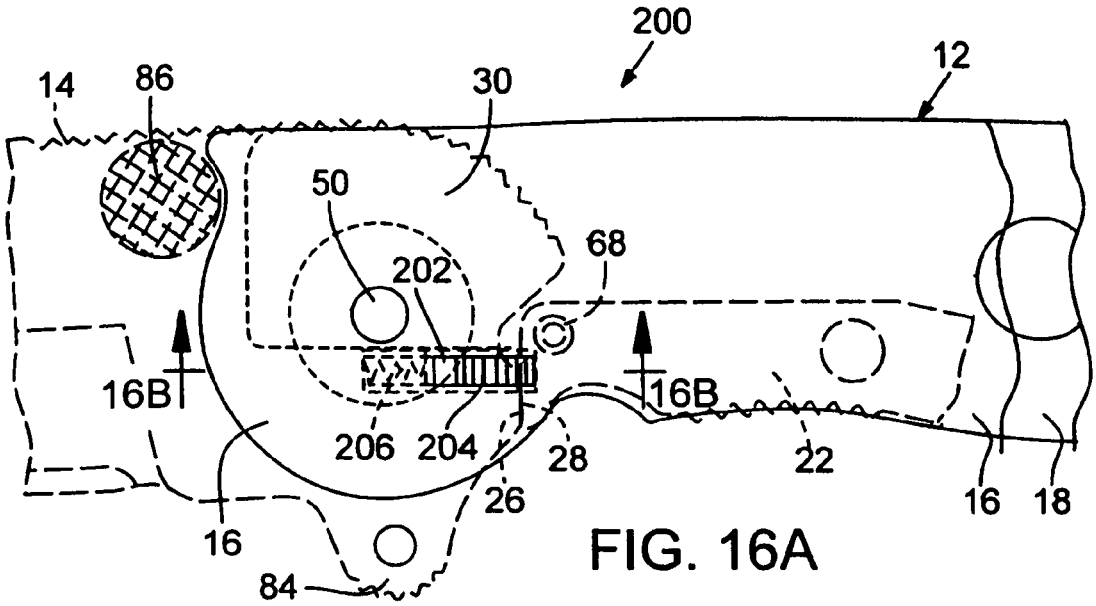
FIG. 16A is an enlarged, fragmentary view of a folding knife having a safety mechanism and a liner lock, according to another embodiment.
Figure 16B:
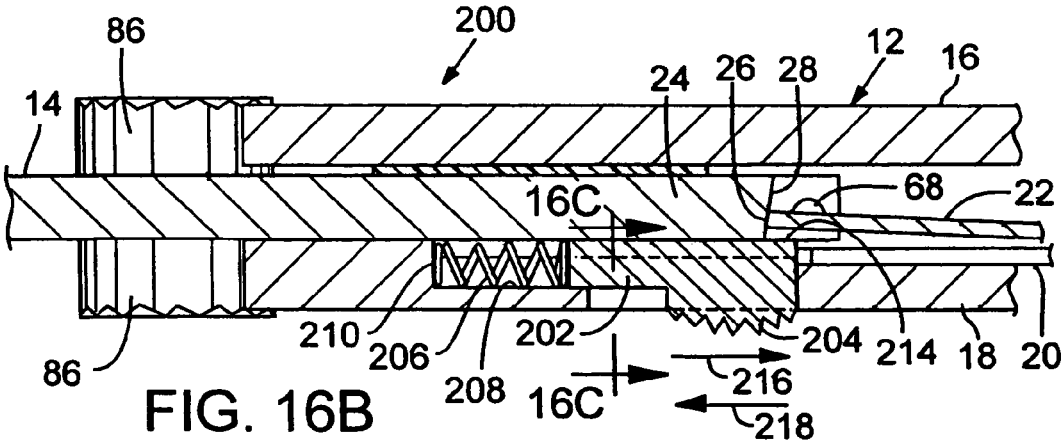
FIG. 16B is a cross-sectional view of the knife shown in FIG. 16A taken generally along line 16B-16B in FIG. 16A.
Figure 16C:
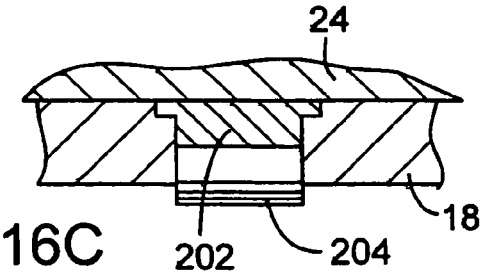
FIG. 16C is a cross-sectional view of the knife shown in FIG. 16A taken generally along line 16C-16C in FIG. 16B.

FIGS. 16A-16C show a folding knife 200, according to another embodiment. This embodiment shares many similarities with the embodiment of FIGS. 1-8. Hence, components in FIG. 16A-16C that are identical to corresponding components in FIGS. 1-8 have the same respective reference numerals and are not described further.

The knife 200 includes safety mechanism comprising a sliding latch 202 positioned in an opening 208 formed in a side panel 18 of the handle 12. The latch 202 includes a projection, or raised portion, 204 that extends laterally outwardly from the opening 208 in the side panel 18 for manual engagement by a user. A coil spring 206 disposed in the opening extends between the latch 202 and an opposing surface 210 of the side panel 18. The latch 202 is slidable within the opening 208 in the opposite directions indicated by arrows 216 and 218 between a safety position (shown in FIGS. 16A and 16B) and a release position. The biasing force of the spring 206 urges the latch 202 toward the safety position in the direction of arrow 216. In the safety position, an end portion 214 of the latch 202 extends beyond the tang portion 24 of the knife and overlaps the free end of the locking arm 22 to prevent inadvertent lateral movement of the locking arm to its unlocked position. When the latch 202 is moved toward the front of the handle portion 12 to the release position (in the direction of arrow 218), the latch end portion 214 is moved forwardly of the locking arm 22 so that the locking arm 22 can be moved to its unlocked position for closing the knife blade 14. The biasing force of the spring 206 maintains the latch 202 in the safety position unless sufficient positive pressure is applied to the latch to overcome the biasing force.

Figure 17:
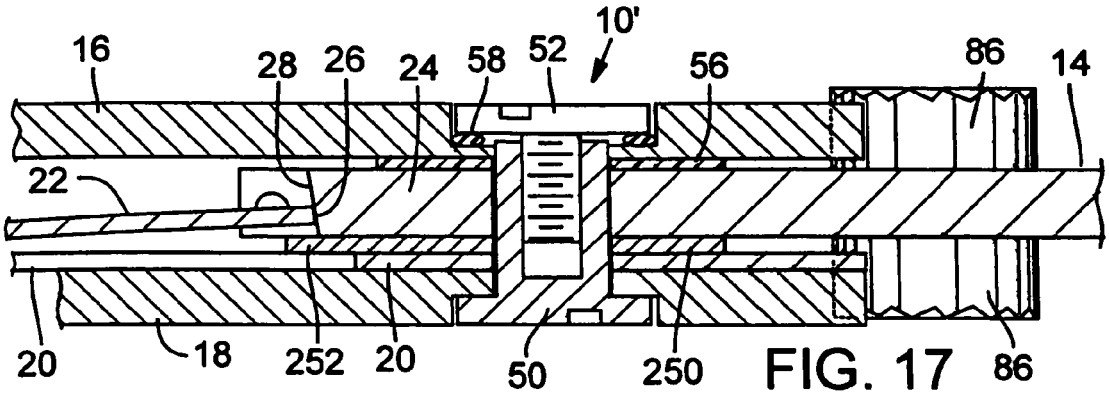
FIG. 17 is an enlarged, fragmentary cross-section view of a folding knife having a liner lock and safety mechanism, according to another embodiment.

FIG. 17 shows a knife 10' having a construction similar to the knife 10 shown in FIGS. 1-8. The knife 10' includes a safety mechanism 250 that is similar in construction to the safety mechanism 30 of FIGS. 1-8 except that the safety mechanism 250 includes a flat extension portion 252, rather than a laterally extending tab portion 36, for resisting lateral movement of the locking arm 22. In this embodiment, the safety mechanism 250 is situated between the tang portion 24 of the blade 14 and an inner surface of the liner lock 20. The safety mechanism can be provided with a biasing mechanism, such as the spring 40 (FIGS. 2 and 3) or any of the various other biasing mechanism disclosed herein, to bias the safety mechanism toward the safety position.

Figure 24:
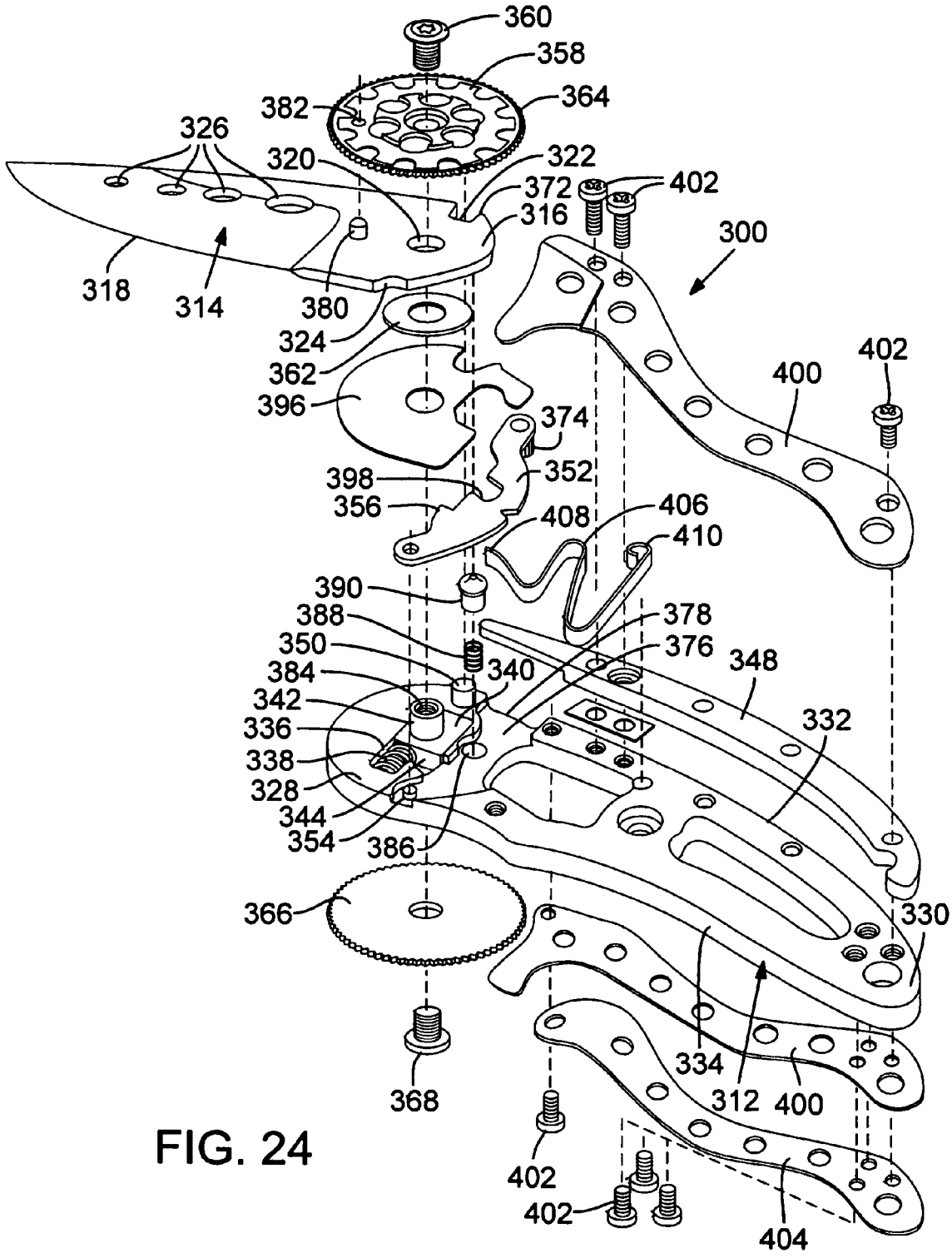
FIG. 24 is a perspective, exploded view of the knife of FIG. 18.

FIGS. 18-28 show a folding knife 310, according to one embodiment. The knife 310 generally includes a handle portion, or frame, 312 and a blade 314 that is pivotally coupled to the handle portion 312 for pivoting movement between an open position (FIGS. 18 and 19) and a closed position (FIGS. 20-23). As best shown in FIG. 24, the blade 314 has a tang portion 316 at its inner end and a conventional sharpened lower edge 318. The illustrated blade 314 also includes an opening 320, a locking slot 322, and a detent 324 formed in the tang portion 316 opposite locking slot 322. The blade 314 can have any of various shapes or configurations. For example, the blade 314 can have a series of spaced-apart openings 326 along its length to reduce the overall weight of the knife.

As shown in FIG. 24, the knife 310 can include side members 400 mounted on opposite sides of the handle portion 312 by screws 402 and a clip 404 mounted to one of the side members 400.

Figure 28:
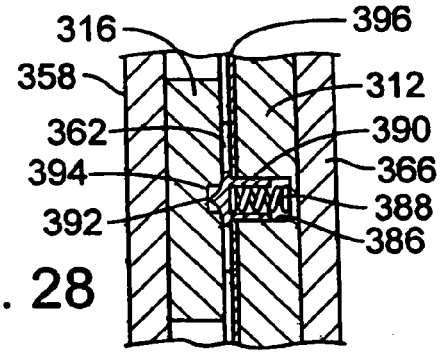
FIG. 28 is a cross-sectional view of the knife taken along line 28-28 of FIG. 27.

The handle portion 312 has a forward end portion 328 coupled to the tang portion 316, a rear end portion 330, an upper surface 332, and a lower surface 334. The forward end portion 328 can be formed with an opening 386 that receives a compression spring 388 and a cylindrical projection 390. As shown in FIG. 28, the spring is partially received within the projection 390 and exerts a biasing force urging the projection against the side of the tang portion 316 of the blade. The outer end of the projection 390 is formed with a nipple portion 392 that is received within a detent 394 in the tang portion 316 when the blade is in the closed position. The force of the projection 390 against the side of the tang portion 316 assists in preventing the blade 314 from opening under its own weight.

Figure 25:
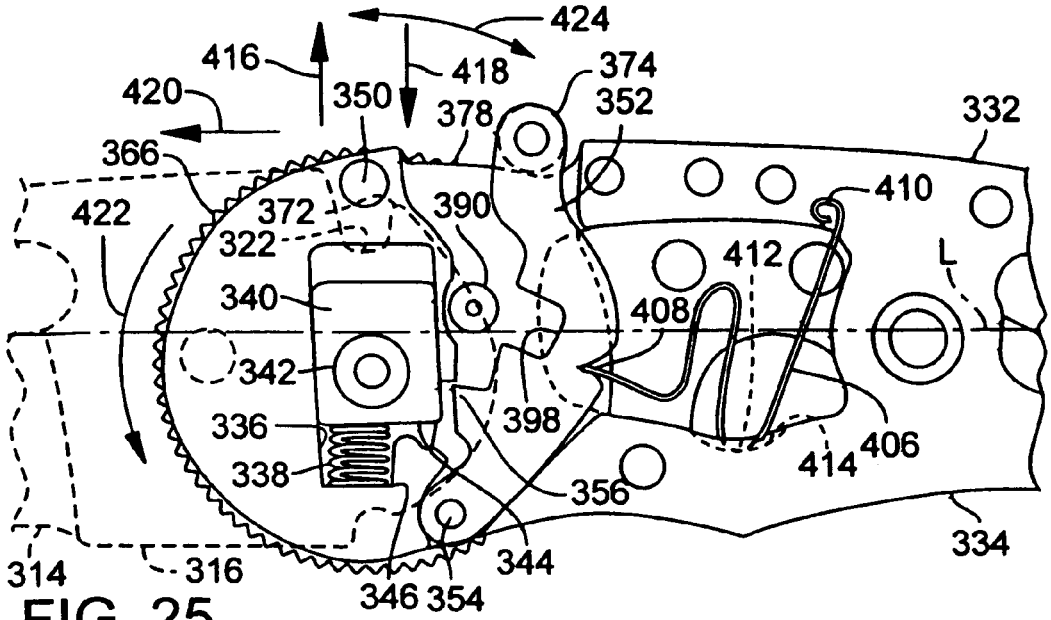
FIG. 25 is an enlarged, fragmentary side elevation view of the knife of FIG. 18, showing the locking lever of the knife in an unlocked position and the blade displaced relative to the handle portion so as to allow pivoting of the blade to the closed position.
Figure 26:
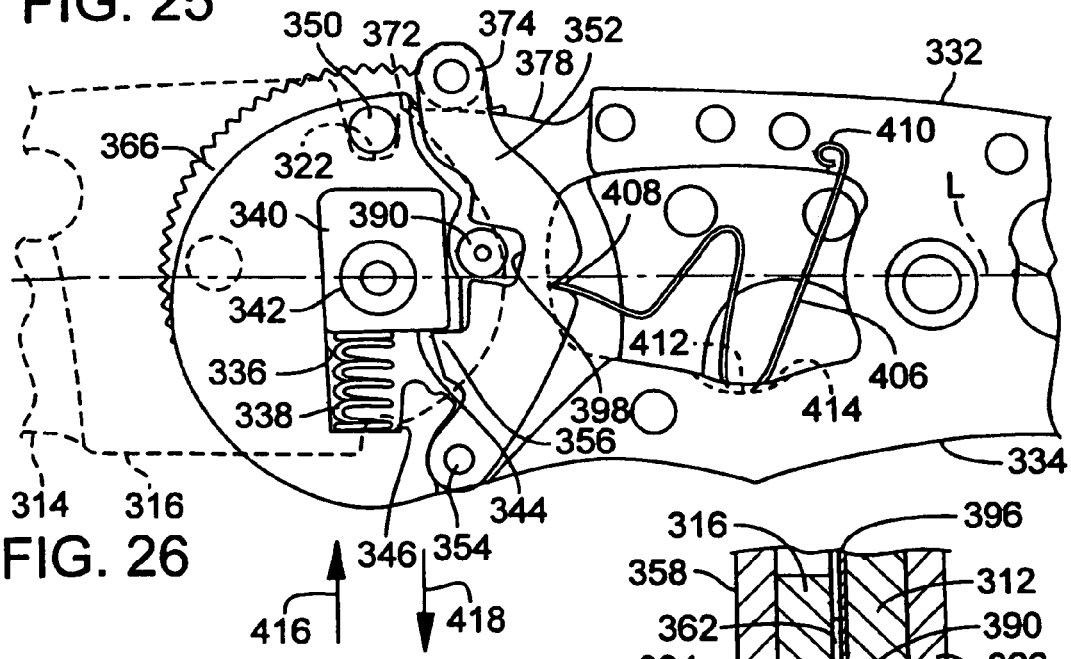
FIG. 26 is an enlarged, fragmentary side elevation view similar to FIG. 25, but showing a locking pin engaging a locking slot in the tang portion of the blade and the locking lever in a locked position to prevent pivoting of the blade.

The handle portion 312 defines a longitudinal axis L (FIGS. 25 and 26) extending between the forward end portion 328 and the rear end portion 330. As best shown in FIGS. 24-26, the forward end portion 328 in the illustrated embodiment is formed with an elongated slot 336 that contains at least one biasing member, such as the illustrated compression spring 338, and the base 340 of a pivot pin 342. The pivot pin 342 extends transversely from the base 340 through a shim 396 and into the opening 320 of the tang portion 316 for pivotally supporting the blade 314 relative to the handle portion 312.

The slot 336 in the illustrated configuration is dimensioned to permit limited displacement of the base 340 in the slot along an axis that is generally perpendicular to the longitudinal axis L of the handle portion 312, as indicated by arrows 416 and 418 in FIGS. 25 and 26. This allows for corresponding displacement of the blade 314 in the same directions in the plane within which the blade 314 pivots. The spring 338 extends between a lower surface 344 of the base 340 and an opposing surface 346 (FIGS. 25 and 26) of the slot 336 so as to resiliently urge the base 340, and therefore the blade 314, in a direction toward the upper surface 332 of the handle portion 312 (in the direction indicated by arrow 380). The handle portion 312 also can include a blade guard 348 mounted adjacent the upper surface 332 of the handle portion 312 by screws 402 to cover the sharpened edge 318 of the blade 314 when the blade is in the closed (folded) position.

Figure 27:
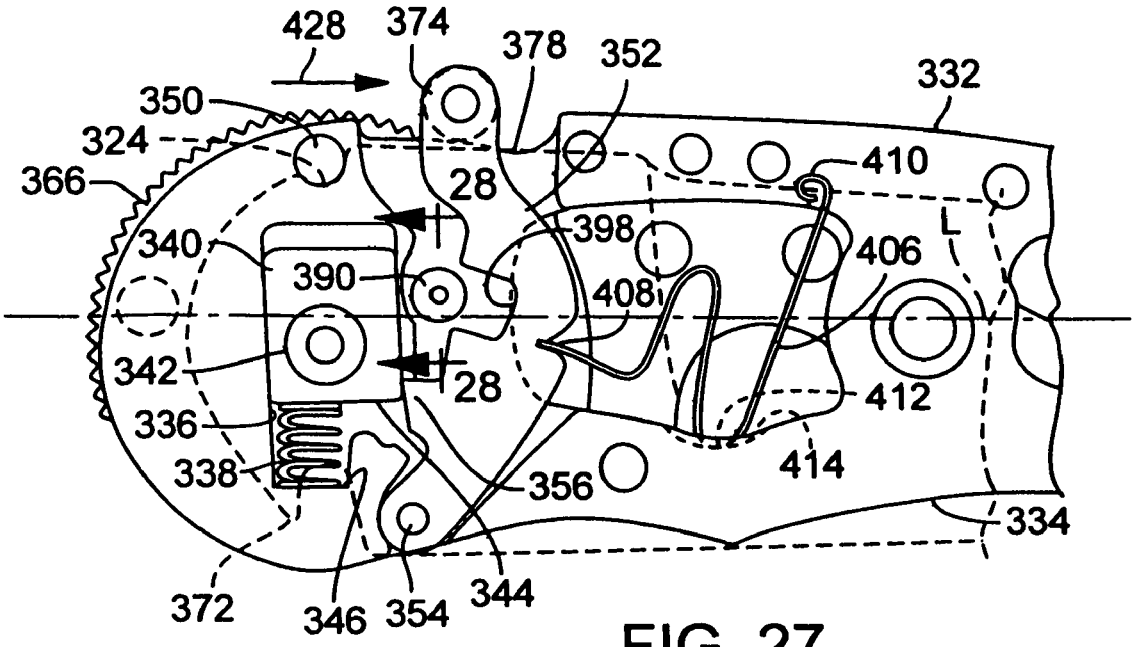
FIG. 27 is an enlarged, fragmentary side elevation view similar to FIG. 26, but showing the blade in the closed position.

The knife 310 desirably includes a locking member to prevent pivoting movement of the blade 314 when it is in the open position. For example, in the illustrated embodiment, a locking pin 350 extends transversely from a side surface of the forward end portion 328 of the handle portion 312 (as best shown in FIG. 24). As shown in FIG. 26, the locking pin 350 is positioned to engage the locking slot 322 of the blade 314 and prevent pivoting movement of the blade when it is in the open position. The blade 314 is releasable from engagement with the locking pin 350 in response to displacement of the blade relative to the handle portion 312 in the direction of arrow 418, as further described below. As shown in FIG. 27, the locking pin 350 also engages the detent 324 in the tang portion 316 when the blade is pivoted to the closed position.

Figure 18:
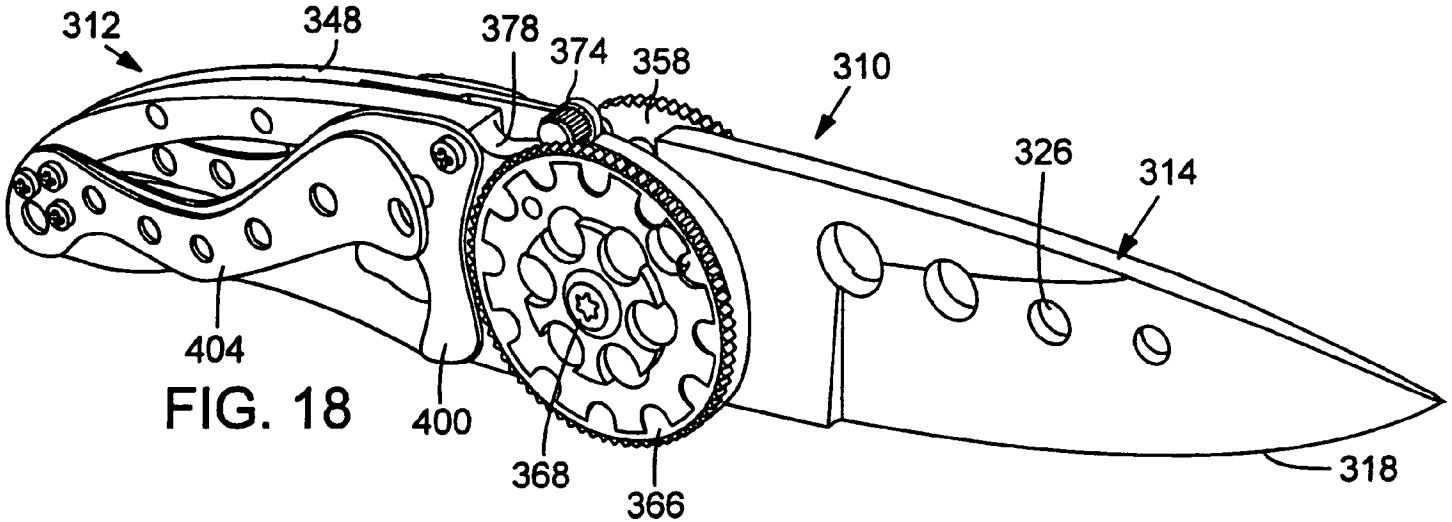
FIG. 18 is a perspective view of a folding knife showing the blade in an open position for use, as viewed from the top and one side of the knife, according to another embodiment.
Figure 19:
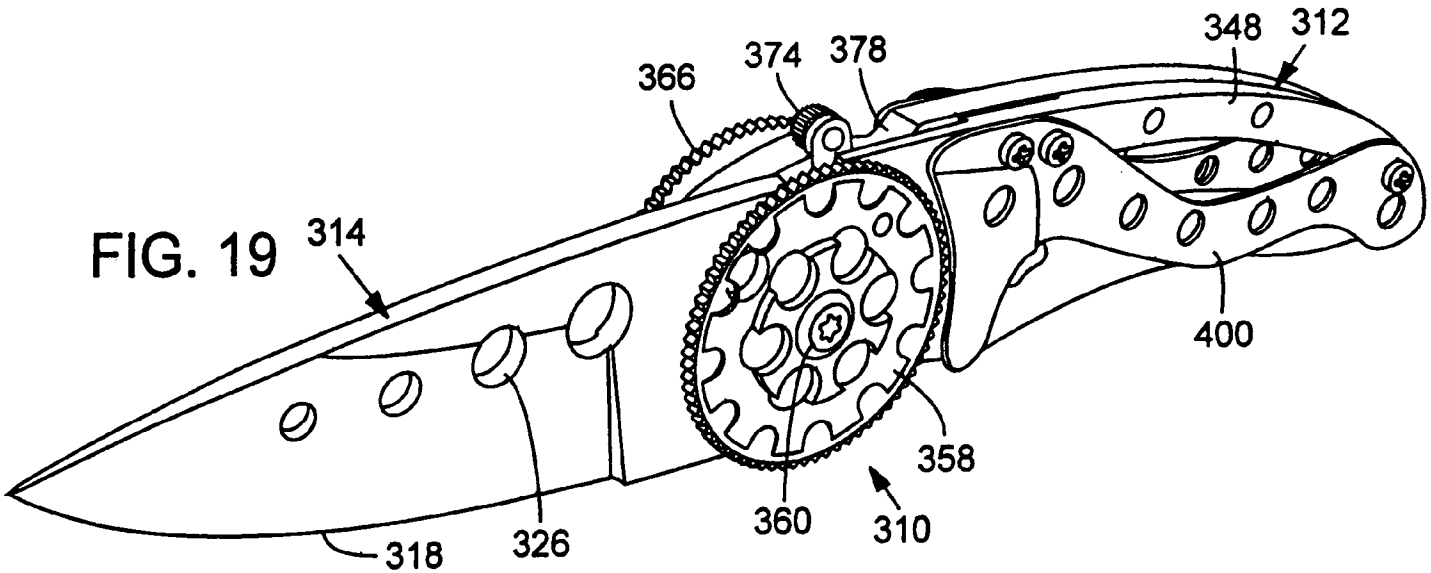
FIG. 19 is a perspective view of the folding knife shown in FIG. 18, as viewed from the top and the opposite side of the knife.
Figure 20:
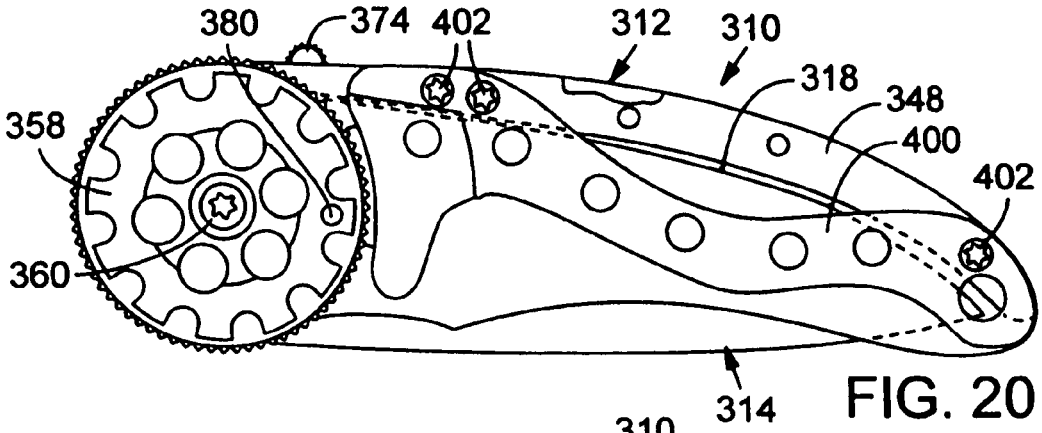
FIG. 20 is a side elevation view of the knife of FIG. 18 showing the blade in a closed position.
Figure 21:
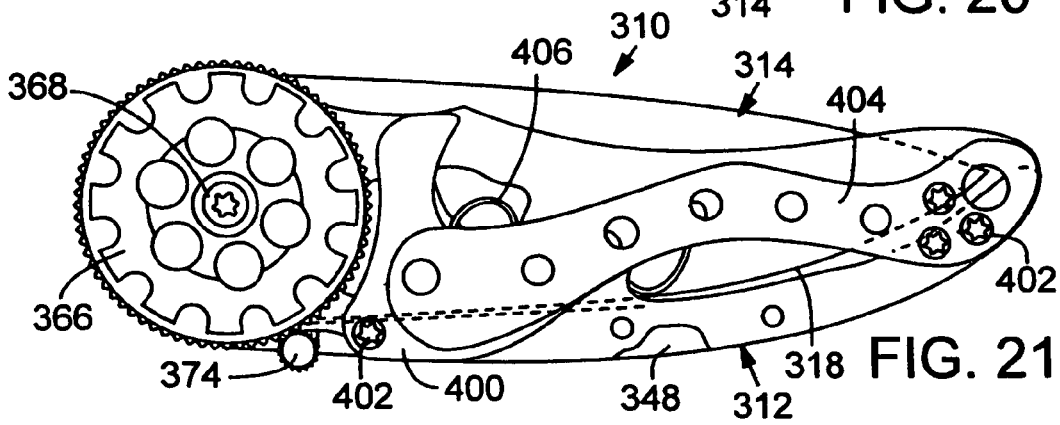
FIG. 21 is an elevation view of the opposite side of the knife of FIG. 18.
Figure 22:
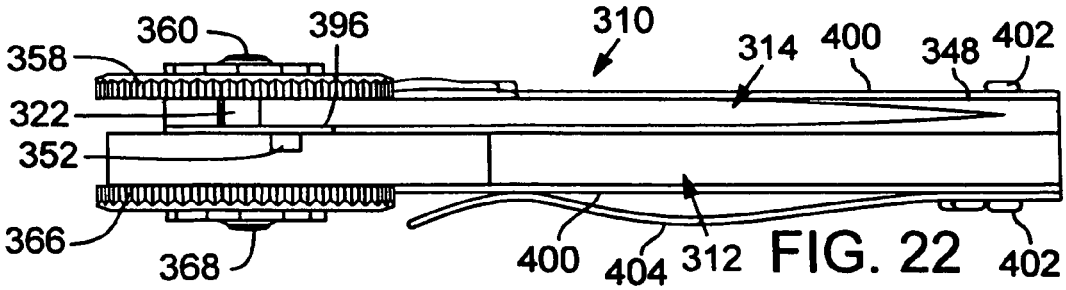
FIG. 22 is a bottom plan view of the knife of FIG. 18 showing the blade in the closed position.
Figure 23:
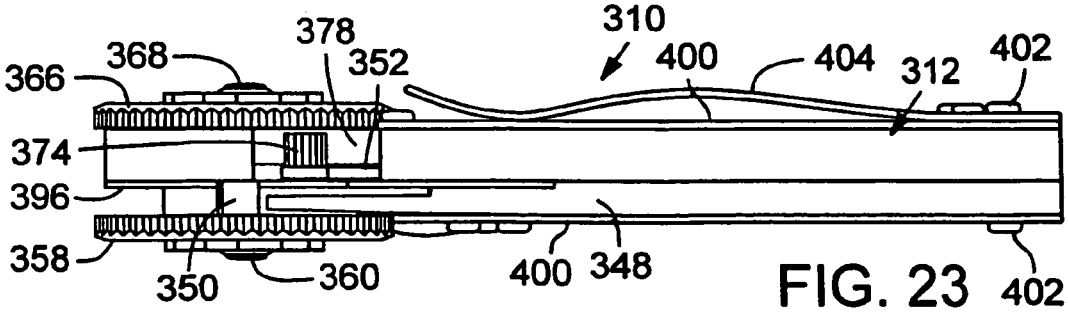
FIG. 23 is a top plan view of the knife of FIG. 18 showing the blade in the closed position.

The knife 310 desirably includes a safety mechanism configured to prevent inadvertent displacement of the blade 314 when it is in the open and/or closed positions. In the illustrated embodiment, the safety mechanism comprises a pivotable locking ever 352 is disposed in a recessed portion 376 formed in the forward end portion 328 of the handle portion 312. The locking lever is pivotally coupled to the forward end portion 328 by a pivot pin 354 (as best shown in FIGS. 25 and 26). As best shown in FIGS. 18 and 19, a projection or stud 374 extending laterally from the upper portion of the locking lever 352 resides in an elongated recessed portion 378 formed in the upper surface 332 of the handle portion 312. The projection 374 is exposed for manual engagement by a user and can have a knurled outer surface as shown to provide a gripping surface.

The locking lever 352 can be manually pivoted toward and away from the base 340 about the pin 354 by moving the projection 374 (as indicated by double-headed arrow 424 in FIGS. 25 and 26). The locking lever 352 can be pivoted between a first, locked position (shown in FIG. 26) and a second, unlocked position (shown in FIG. 25). The locking lever 352 includes an extension 356 positioned to engage the lower surface 344 of the base 340 when the locking lever 352 is in the locked position. Engagement of the extension 356 with the lower surface 344 prevents displacement of the base 340 within the slot 336, thereby preventing displacement of the blade 314. The locking lever 352 is also formed with a notch or recessed portion 398 sized to accommodate the projection 390 when the locking lever 352 is in the locked position.

The locking lever 352 preferably is normally biased toward the locked position shown in FIG. 26 so that it is retained in the locked position until positive pressure is applied in the opposite direction to move the locking lever to the unlocked position. As shown in FIGS. 25 and 26, this can be accomplished by a spring 406 disposed within an aperture 426 formed in the handle portion 312 and positioned to exert a biasing force against the locking lever 352. The spring 406 in the illustrated configuration comprises a flat metal strip formed with multiple bends that produces a biasing force when compressed. A first end portion 408 of the spring is retained in a slot formed in the locking lever 352 and a curved, second end portion 410 is retained in a correspondingly shaped opening in the handle portion 312. An intermediate bent portion 412 of the spring 406 extends into a slot or opening 414 formed in the interior portion the handle portion 312 to secure the spring in place within the handle portion.

When manual pressure is not applied to the locking lever 352, the locking lever 352 is retained in the locked position shown in FIG. 26 under the biasing force of the spring 406. To move the locking lever 352 to the unlocked position shown in FIG. 25, a user must apply sufficient pressure to the locking lever to overcome the biasing force of the spring 406. Movement of the locking lever to the unlocked position compresses the spring 406 as shown in FIG. 25. Hence, releasing pressure from the locking lever causes it to automatically move back to the locked position under the force of the spring.

Biasing mechanism other than the illustrated spring 406 can be used to bias the locking lever to the locked position. For example, a compression spring, leaf spring, torsion spring, or other equivalent mechanism can be employed to provide a biasing force to the locking lever.

In alternative embodiments, the safety mechanism can take other forms. For example, rather than the pivotal locking lever 352, a slidable latch is incorporated into the handle portion 312. The latch is slidable between a forward, locked position in which the latch engages the base 340 of the pivot pin to prevent displacement of the blade and a rearward, unlocked position (away from the base 340) in which the latch is removed from engagement with the base 340 to allow movement of the blade. A biasing mechanism, such as a compression spring, can be used to bias the latch to the locked position.

To assist in opening and closing the blade 314, a first disc member, or wheel, 358 can be mounted to the tang portion 316 of the blade. As best shown in FIG. 24, the disc member 358 can be mounted by a screw 360 extending through a central opening in the disc member and a washer 362, and tightened into a threaded opening 384 in the pivot pin 342. A pin 380 secured to the tang portion 316 extends through a respective opening 382 in the disc member 358 to prevent rotation of the disc member relative to the blade 314. The disc member 358 can include a knurled, outer peripheral surface 364 that serves as a gripping surface for manually rotating the disc member. Rotation of the disc member 358 about the screw 360 is effective to cause pivoting movement of the blade 314 about the pivot pin 342. If desired, a second disc member, or wheel, 366 can be mounted to the knife opposite the first disc member 358. As shown, the second disc member 366 can be mounted by a screw 368 extending through a central opening in the disc member, and tightened into a threaded opening (not shown) in the base 340 of the pivot pin 342.

Referring to FIGS. 25 and 26, the operation of the knife 310 will now be described. FIG. 26 shows the blade 314 in its fully extended, open and locked position. In this position, the spring 338 urges the base 340, and therefore the blade 314, toward the upper surface 332 of the handle portion 312 (in the direction of arrow 416) so as to cause the locking pin 350 to engage the locking slot 322 of the blade. As noted above, engagement of the locking pin 350 with the locking slot 322 retains the blade against pivoting movement relative to the handle portion. In addition, the extension portion 356 of the locking lever 352 engages the lower surface 344 of the base 340 to prevent inadvertent displacement of the blade 314 relative to the handle portion. Thus, in this position, the blade 310 is securely fixed against any movement relative to the handle portion 312. In addition, the spring 406 retains the locking lever 352 in its locked position to further protect against movement of the blade unless sufficient positive pressure is applied to the locking lever to overcome the biasing force of the spring 406.

The blade 314 can be released for pivotal movement with respect to the handle portion 312 by first moving the locking lever 352 to its unlocked position (shown in FIG. 25) so that the extension 356 clears the lower surface 344 of the base. Manual pressure is then applied to the disc members 358, 366 in the direction of arrow 418. This can be accomplished by grasping the knife 310 in a normal manner and pressing downwardly on the disc members 358, 366 with the thumb. The manual pressure shifts the blade 314 in the direction of arrow 418 and away from the locking pin 350. When the locking pin 350 clears the locking slot 322, as shown in FIG. 25, the blade 314 is free to pivot toward the closed position, in the direction indicated by arrow 422.

Notably, the blade 314 can be unlocked and folded to its closed position using only one hand. For example, holding the knife in a normal manner, the locking lever 352 is moved to its unlocked position (FIG. 25) with the thumb. While retaining pressure on the locking lever 352 to keep it in its unlocked position, pressure is also applied to the disc member 358 in the direction of arrow 418 with the thumb to release the blade from the locking pin 350. When the locking pin 350 clears the locking slot 322, pressure is then applied to the disc member 358 in the general direction of arrow 420 (FIG. 25) with the thumb to cause rotation of the disc member 358 and corresponding pivoting movement of the blade 314. As the blade is pivoted to the closed position, pressure on the disc member 358 in the direction of arrow 418 can be released once the inner edge 372 of the locking slot 322 is rotated past the locking pin 350. The disc member 358 can be rotated with the thumb until the blade is in the closed position.

The closed (folded) position of the knife 310 is shown in FIG. 27. In this position, the blade 314 has been pivoted until the locking pin 350 engages the detent 324 in the tang portion 316. The folded knife blade 314 desirably does not contact the blade guard 348 to protect the sharpened edge 318 from damage. The bias of the compression spring 338 resiliently urges the blade 314 against the locking pin 350. The biasing force of the spring 338 desirably is sufficient to prevent the blade 314 from swinging open under its own weight. Using only one hand, the knife blade 314 can be returned to the open position by simply applying pressure to the disc member 358 in the general direction of arrow 428 (FIG. 27) with the thumb to cause rotation of the disc member and corresponding pivoting movement of the blade. When the blade is pivoted to the fully open position, the blade "snaps" into the engaged position with the locking pin 352 and the locking lever 352 "snaps" into the locked position engaging the base 340 of the locking pin 342. Consequently, this method of opening the knife does not require the user to turn over and fling the wrist and/or forearm downwardly, as is typically done when opening a conventional folding knife with only one hand.

As can be appreciated, the knife 310 is especially useful to persons who experience difficulty in using two hands to open or close a folding knife because of a physical impairment or other reasons. Of course, if desired, the knife 310 can be opened and/or closed in a two-handed operation by simply grasping the handle portion 312 with one hand and using the other hand to pivot the blade 314 to the open or closed position.

In an alternative embodiment, the detent 324 can have a shape similar to that of the locking slot 322 so that the blade 314 is retained against pivoting movement by the locking pin 350 when the blade is in the closed position. In this alternative embodiment, the blade 314 can be opened by applying sufficient pressure to the disc member 358 in the direction of arrow 418 (FIGS. 25 and 26) to release the blade from the locking pin 350 and then applying a rotating force to the disc member to cause pivoting movement of the blade.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A folding knife comprising:

a handle portion;

a blade pivotally coupled to the handle portion and operable to pivot relative to the handle portion about a pivot axis between an open position for use and a folded, closed position;

a locking mechanism comprising a leaf spring disposed in the handle portion and being biased to a locked position contacting and in line with the blade for preventing pivoting of the blade from the open position to the closed position, the leaf spring being movable laterally of the handle portion from the locked position to an unlocked position in which the blade can pivot from the open position to the closed position;

a safety mechanism comprising a contact surface, a user engagement projection for pivoting the contact surface and a spring engagement surface, wherein the safety mechanism is located in a first recess in the handle portion surrounding the pivot axis and is operable to pivot about the pivot axis between a safety position and a release position, wherein when the safety mechanism is pivoted to the safety position, the contact surface of safety mechanism can contact and prevents the leaf spring from being moved to the unlocked position, and wherein when the safety mechanism is pivoted to the release position, the safety mechanism allows the leaf spring to be moved to the unlocked position, wherein the safety mechanism is resiliently biased to the safety position; and a cantilever spring located in a second recess in the handle portion and configured to exert a biasing force onto the spring engagement surface of the safety mechanism for biasing the safety mechanism to the safety position.

2. The folding knife of claim 1, wherein:

the handle portion comprises first and second side panels, the locking mechanism being disposed between the first and second side panels.

3. The folding knife of claim 2, wherein:

the safety mechanism comprises a first, laterally bent tab portion projecting toward the first side panel wherein the first tab portion defines the spring engagement surface and the second tab portion defines the contact surface; and a second, laterally bent tab portion projection toward the second side panel;

the spring has an end portion that bears against the spring engagement surface of the first tab portion to bias the safety mechanism toward the safety position;

the contact surface of the second tab portion has a contact surface that contacts the leaf spring when the safety mechanism is moved to the safety position to prevent the leaf spring from being moved to the release position.

4. The folding knife of claim 1, wherein the user engagement projection is moved to a forward-most position toward the front of the handle portion when the safety mechanism is pivoted to the safety position, and wherein the safety mechanism can be manually moved to the release position by moving the user engagement projection rearwardly toward the rear of the handle portion.

5. A folding knife comprising:

a handle portion;

a blade pivotally coupled to the handle portion and operable to pivot relative to the handle portion between an open position for use and a folded, closed position;

a locking mechanism having a locking element that is movable between a locked position and an unlocked position, wherein when the locking element is in the locked position, the locking element prevents pivoting of the blade from the open position to the closed position and wherein when the locking element is in the unlocked position, the blade can be pivoted from the open position to the closed position;

a safety mechanism that is movable between a safety position and a release position, wherein when the safety mechanism is in the safety position, the safety mechanism prevents movement of the locking element to the unlocked position, and wherein when the safety mechanism is in the release position, the locking element can be moved to the unlocked position; and a biasing mechanism configured to exert a biasing force that urges the safety mechanism toward the safety position, wherein the safety mechanism can be moved from the safety position to the release position against the biasing force;

wherein the locking mechanism comprises a liner lock extending longitudinally of the handle portion and the locking element comprises a resilient locking arm of the liner lock, wherein when the locking arm is in the locked position and the blade is in the open position, the locking arm engages an end edge of the blade to prevent pivoting thereof, the locking arm being movable laterally toward one side of the handle portion to release the locking arm from engagement with the blade to permit pivoting thereof;

wherein the safety mechanism comprises a contact surface, a user engagement projection for pivoting the contact surface and a biasing mechanism engagement surface for engaging an end of the biasing mechanism, and is configured to pivot the contact surface between the safety position and the release position, wherein when safety mechanism is in the safety position, the contact surface contacts and prevents movement of the locking element to the unlocked position, and wherein the safety mechanism is in the release position, the contact surface allows movement of the locking element to the unlocked position;

wherein the safety mechanism is located in a first recess in the handle portion surrounding a blade pivot axis; and wherein the biasing mechanism comprises a cantilever spring located in a second recess in the handle portion.

6. The folding knife of claim 5, wherein:

the handle portion comprises first and second side panels, the liner lock being disposed between the first and second side panels.

7. The folding knife of claim 5, wherein the spring has a first, fixed end portion that is fixed relative to the handle portion and a second end portion that bears against the biasing mechanism engagement surface of the safety mechanism to cause the safety mechanism to pivot to the safety position under the biasing force.

8. The folding knife of claim 5, wherein the user engagement projection is moved to a forward-most position toward the front of the handle portion when the safety mechanism is moved to the safety position by the biasing mechanism, and wherein the safety mechanism can be manually moved to the release position by manually moving the user engagement projection rearwardly toward the rear of the handle portion against the biasing force of the biasing mechanism.

* * * * *